US005658455A

United States Patent [19]

Hammond et al.

[11] Patent Number: 5,658,455

[45] Date of Patent: Aug. 19, 1997

[54] FLUIDIZED BED COKING PROCESS

[75] Inventors: David G. Hammond, Madison; Mitchell Jacobson, West Orange; John F. Pagel, Cedar Knolls, all of N.J.; Martin C. Poole, Baton Rouge, La.; Robert C. Green, Berkley Heights, N.J.; Willibald Serrand, Buxheim, Germany

[73] Assignee: Exxon Research & Engineering Company, Florham Park, N.J.

[21] Appl. No.: 503,406

[22] Filed: Jul. 17, 1995

[51] Int. Cl.[6] ..... C10G 9/28; C10G 51/04; C10B 57/02

[52] U.S. Cl. ..... 208/127; 208/85; 208/49; 208/50; 208/53; 208/67; 208/106

[58] Field of Search ..... 208/127, 85, 49, 208/50, 53, 67, 106

[56] References Cited

U.S. PATENT DOCUMENTS

| | | | |
|---|---|---|---|
| 2,421,616 | 6/1947 | Hemminger et al. | 208/113 |
| 2,700,637 | 1/1955 | Knox, Jr. | 208/309 |
| 2,952,617 | 9/1960 | Haig | 208/127 |
| 2,952,619 | 9/1960 | Metrailer et al. | 208/127 |
| 2,994,659 | 8/1961 | Slyingstad et al. | 208/113 |
| 3,193,494 | 7/1965 | Sanford et al. | 208/113 |
| 3,353,925 | 11/1967 | Baumann et al. | 208/113 |
| 4,587,010 | 5/1986 | Blaser et al. | 208/127 |
| 4,619,788 | 10/1986 | Pratt et al. | 208/85 |
| 4,663,019 | 5/1987 | Gartside et al. | 208/127 |
| 4,749,470 | 6/1988 | Herbst et al. | 208/85 |
| 4,985,136 | 1/1991 | Bartholic | 208/153 |
| 5,501,789 | 3/1996 | Bartholic | 208/127 |

OTHER PUBLICATIONS

H. Weiss, J. Schmalfeld. "Coking of Residue Oils by the LR–Process" Sonderdruck aus Erdol & Kohle–Erdgas–Petrochemie/Hydrocarbon Technology, 42, 235–237 (1989) Month N/A.

H.J. Weiss, J. Schmalfeld. "Coking of Oil Sand, Asphaltenes and Residual Oils in the LR–Process" Fourth UNITAR/UNDP Intl. Conf. on Heavy Crude & Tar Sands (paper #144) Aug. 1988.

H. Weiss, J. Schmalfeld, R.B. Solari. "Coking of Oil Sands, Asphaltenes and Residual Oils in the LR–Process", paper presented at the 5th UNITAR Conference Aug. 9, 1988.

*Primary Examiner*—Glenn A. Caldarola
*Assistant Examiner*—Patricia L. Hailey
*Attorney, Agent, or Firm*—Henry E. Naylor

[57] ABSTRACT

An improved fluidized bed coking process wherein a residuum feedstock is introduced into a first stage comprised of a short vapor contact time reactor containing a horizontal moving bed of fluidized hot particles. Carbonaceous material is deposited onto the hot particles on contact with the hot particles, and a vapor product is produced. The hot particles, containing the carbonaceous deposits, are fed to a second stage fluidized bed coking process.

7 Claims, 1 Drawing Sheet

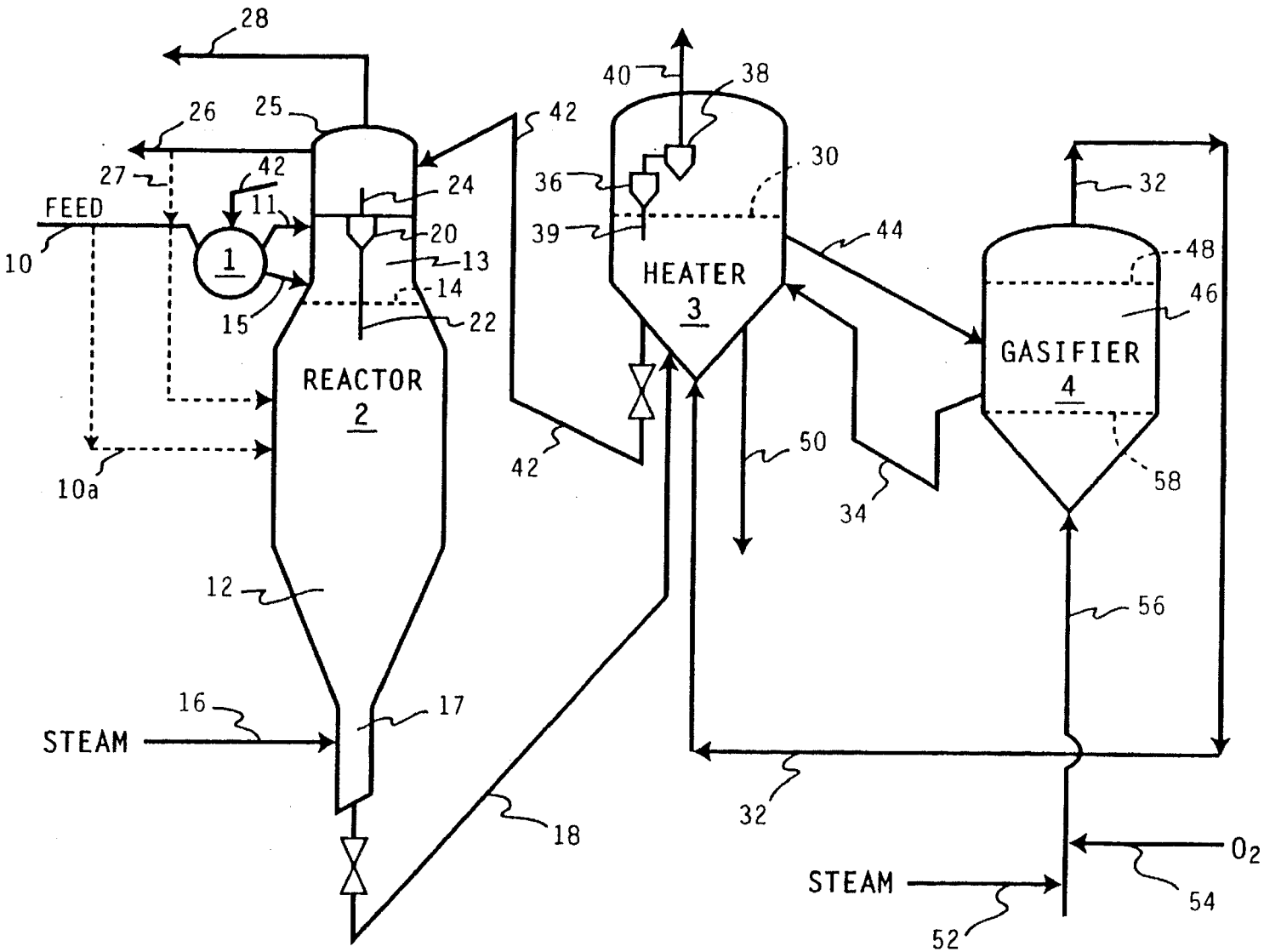
GASIFIER
4
HEATER
3
REACTOR
2
1
FEED
STEAM
STEAM
$O_2$
10
10a
11
12
13
14
15
16
17
18
20
22
24
25
26
27
28
30
32
32
34
36
38
39
40
42
42
42
44
46
48
50
52
54
56
58

FLUIDIZED BED COKING PROCESS

FIELD OF THE INVENTION

The present invention relates to an improved fluidized bed coking process wherein a residuum feedstock is introduced into a first stage comprised of a short vapor contact time reactor containing a horizontal moving bed of fluidized hot particles. Carbonaceous material is deposited onto the hot particles on contact with the hot particles, and a vapor product is produced. The hot particles, containing the carbonaceous deposits, are fed to a second stage fluidized bed coking process.

BACKGROUND OF THE INVENTION

Although refineries produce many products, the most desirable are the transportation fuels gasolines, diesel fuels, and jet fuels, as well as light heating oils, all of which are high-volume, high value products. While light heating oils are not transportation fuels, their hydrocarbon components are interchangeable with diesel and jet fuels, differing primarily in their additives. Thus, it is a major objective of petroleum refineries to convert as much of the barrel of crude oil into transportation fuels as is economically practical. The quality of crude oils is expected to slowly worsen with sulfur and metals content and densities increasing. Greater densities mean that more of the crude oil will boil above about 560° C., and thus will contain higher levels of Conradson Carbon and/or metal components. Historically, this high-boiling material, or residua, has been used as heavy fuel oil, but the demand for these heavy fuel oils has been decreasing because of stricter environmental requirements. This places greater emphasis on refineries to process the entire barrel of crude to more valuable lower boiling products.

Coking processes are presently the major refinery processes for converting heavy feeds, such as residua, to more valuable lower boiling products, but are typically too severe for obtaining optimum mounts of gasoline and distillate boiling products without producing an undesirable amount of coke and light gases. It would be desirable to first distill, or vaporize, volatile materials of resids prior to coking to obtain higher yields of such desirable transportation fuel products.

The two types of coking most commonly commercially practiced are delayed coking and fluidized bed coking. In delayed coking, the resid is heated in a furnace and passed to large drums maintained at temperatures from about 415° C. to 540° C. During a long residence time in the drum at such temperatures, the resid is converted to coke. Liquid products are taken off the top for recovery as "coker gasoline", "coker gas oil", and gas. Conventional fluidized bed coking process units typically include a coking reactor and a burner. A petroleum feedstock is introduced into the coking reactor containing a fluidized bed of hot solids, preferably coke, and is distributed uniformly over the surfaces of said coke particles where it is cracked to vapors and to carbonaceous material which is deposited onto the particles. The vapors pass through cyclones which remove most of the entrained coke particles. The vapor is then discharged into a scrubbing zone where remaining coke particles are removed and the products are cooled to condense heavy liquids. The resulting slurry, which usually contains from about 1 to about 3 wt. % coke particles, is recycled to extinction to the coking zone.

The coke particles in the coking zone flow downwardly to a stripping zone at the base of the coking reactor where a stripping gas, such as steam, is used to remove interstitial product vapors from, or between, the coke particles, as well as some adsorbed liquids from the coke particles. The coke particles then flow down a stand-pipe and into a riser which moves them to a burner where sufficient air is injected for burning at least a portion of the coke and heating the remainder sufficiently to satisfy the heat requirements of the coking zone where the unburned hot coke is recycled. Net coke, above that consumed in the burner, is withdrawn as product coke.

While fluidized bed coking has met with a substantial amount of commercial success, there still remains a need in the industry for methods that can increase the liquid yields, the quality of liquids, or both.

SUMMARY OF THE INVENTION

In accordance with the present invention, there is provided a two stage process for converting a heavy hydrocarbonaceous feedstock having a Conradson Carbon content of at least about 5 wt. %, to lower boiling products; which process comprises:

(a) partially converting the feedstock to lower boiling products by introducing the feedstock into said first stage which is conducted in one or more short vapor contact time reactors comprised of a horizontal moving bed of fluidized hot particles wherein upon contact of the feedstock with the hot particles vapor phase products are produced and carbonaceous material is deposited onto the hot particles, which first stage is operated: (i) at a temperature from about 450° C. to about 700° C.; (ii) under conditions such that the solids residence time and the vapor residence time are independently controlled, which vapor residence time is less than about 2 seconds, and which solids residence is from about 5 to about 60 seconds; and (b) further converting said partially converted feedstock to lower boiling products in a second stage comprised of a fluidized bed coking process unit comprised of a coking reactor and a burner, said coking reactor containing a coking zone, a scrubbing zone located above the coking zone for collecting vapor phase products, and a stripping zone located below the coking zone for stripping hydrocarbons from particles passing downwardly from the coking zone, which second stage is operated by:

(i) passing the vapor phase product from said first stage to said scrubbing zone of a fluidized bed coking process unit wherein entrained particles are removed and conversion products are collected overhead;

(ii) collecting, from the scrubbing zone, a stream of light products having an average boiling point equal to or less than about 510° C.;

(iii) collecting, from the scrubbing zone, a product stream having average boiling point of greater than about 510° C.;

(iv) passing, from the first stage, the particles having carbonaceous material deposited thereon to the coking zone of a fluidized bed coking process unit, past the stripping zone where hydrocarbons are stripped with a stripping gas;

(v) passing a portion of said stripped solid particles from the stripping zone to said burner containing a combustion zone which is comprised of a fluidized bed of solid particles and which is operated at a temperature from about 40° to 200° C. greater than that of the coking zone to partially combust carbonaceous material on said particles, thereby heating said particles to a temperature in excess of the temperature of the coking zone; and (vi) recycling at least a portion of the heated particles from the combustion zone to said short contact time reactor of said first stage.

In a preferred embodiment of the present invention, an additional heavy hydrocarbonaceous feedstream is introduced into said coking zone.

In still another preferred emboiment of the present invention, a portion of the hot particles is passed from the burner to the coking zone of the fluid bed coking process unit.

In another preferred embodiments of the present invention, the feedstock is a vacuum resid and the fluidized bed coking process unit contains a coking zone, a heating zone, and a gasification zone wherein the solids are recycled form the heating zone to the coking zone and solids are recycled from the heating zone to the gasification zone, which gasification zone is operated at a temperature from about 870° C. to about 1,100° C.

BRIEF DESCRIPTION OF THE FIGURE

The sole FIGURE hereof is a schematic flow plan of a non-limiting preferred embodiment of the present invention. This FIGURE shows a first stage short vapor contact time horizontal moving bed reactor, followed by a second stage fluidized bed coking process unit. The fluidized bed coking unit depicted in this FIGURE contains a coking reactor, a heater, and a gasifier. It is to be understood that the fluidized bed coking unit can also be comprised of only a coking reactor and a burner.

DETAILED DESCRIPTION OF THE INVENTION

Suitable heavy hydrocarbonaceous feedstocks for use in the present invention include heavy hydrocarbonaceous oils, heavy and reduced petroleum crude oil; petroleum atmospheric distillation bottoms; petroleum vacuum distillation bottoms, or residuum; pitch; asphalt; bitumen; other heavy hydrocarbon residues; tar sand oil; shale oil; coal; coal slurries; liquid products derived from coal liquefaction processes, including coal liquefaction bottoms; and mixtures thereof. Such feeds will typically have a Conradson carbon content of at least 5 wt. %, generally from about 5 to 50 wt. %. As to Conradson carbon residue, see ASTM Test D189-165. Preferably, the feed is a petroleum vacuum residuum.

A typical petroleum chargestock suitable for the practice of the present invention will have the composition and properties within the ranges set forth below.

| | |
|---|---|
| Conradson Carbon | 5 to 40 wt. % |
| Sulfur | 1.5 to 8 wt. % |
| Hydrogen | 9 to 11 wt. % |
| Nitrogen | 0.2 to 2 wt. % |
| Carbon | 80 to 86 wt. % |
| Metals | 1 to 2000 wppm |
| Boiling Point | 340° C.+ to 650° C.+ |
| Specific Gravity | −10 to 35° API |

Reference is now made to the sole FIGURE hereof wherein a heavy hydrocarbonaceous feedstock which is relatively high in Conradson Carbon and/or metal-components is partially converted to lower boiling products in a first stage wherein the feedstock is fed, via line 10, to short vapor contact time reactor 1 which contains a horizontal moving bed of fluidized hot particles which are received from heater 3 via line 42. It is preferred that the particles in the short vapor contact time reactor be fluidized with assistance by a mechanical means. The particles are fluidized by use of a fluidized gas, such as steam, a mechanical means, and by the vapors which result in the vaporization of a fraction of the feedstock. It is preferred that the mechanical means be a mechanical mixing system characterized as having a relatively high mixing efficiency with only minor amounts of axial backmixing. Such a mixing system acts like a plug flow system with a flow pattern which ensures that the residence time is nearly equal for all particles. The most preferred mechanical mixer is the mixer referred to by Lurgi AG of Germany as the LR-Mixer or LR-Flash Coker which was originally designed for processing for oil shale, coal, and tar sands. The LR-Mixer consists of two horizontally oriented rotating screws which aid in fluidizing the particles. Although it is preferred that the solid particles be coke particles, they may be any other suitable refractory material. Non-limiting examples of such other suitable refractory materials include those selected from the group consisting of silica, alumina, zirconia, magnesia, or mullite, synthetically prepared or naturally occurring material such as pumice, clay, kieselguhr, diatomaceous earth, bauxite, and the like. The solids will have an average particle size of about 40 to 1000 microns, preferably from about 500 to 500 microns.

When the feedstock is contacted with the hot solids, which will preferably be at a temperature from about 590° C. to about 760° C., more preferably from about 650° C. to 700° C., a major portion of the feedstock will be vaporized. The residence time of vapor in short contact time thermal zone 1 will be an effective amount of time so that substantial secondary cracking does not occur. This amount of time will typically be less than about 2 seconds, preferably less than 1 second, more preferably less than about 0.5 seconds. That portion of the feed that does not immediately vaporize on contact with the hot solids will form a thin film on the particles where cracking reactions occur. This results in the formation of additional vapor products and a minor amount of carbonaceous material depositing on the hot particles. The residence time of solids in the short vapor contact time reactor will be from about 5 to 60 seconds, preferably from about 10 to 30 seconds. One novel aspect of the present invention is that the residence time of the particles and the residence time of the vapor products in the short vapor contact time reactor are independently controlled. Most fluidized bed processes are designed so that the solids residence time, and the vapor residence time cannot be independently controlled, especially at relatively short vapor residence times. It is preferred that the short vapor contact time reactor be operated so that the ratio of solids to feed be from about 10 to 1, preferably from about 5 to 1. It is to be understood that the precise ratio of solids to feed will primarily depend on the heat balance requirement of the short contact time reactor. Associating the oil to solids ratio with heat balance requirements is within the skill of those having ordinary skill in the art, and thus will not be elaborated herein any further. A minor amount of the feedstock will deposit on the particles the form of combustible carbonaceous material. Metal components will also deposit on the particles. Consequently, the vaporized portion which exits thermal unit 1 via line 11 will be substantially lower in both Conradson Carbon and metals when compared to the original feed. Use of this first stage, in combination with second stage fluidized coking will result in increased liquid yields and decreased gas and coke yields, when compared to fluidized coking alone.

Both the vaporized product stream and the solids are passed to a second stage, the fluidized bed coking stage, via lines 11 and 15 respectively to the space 13 between the top of fluidized solids bed 14 in coking reactor 2 and the scrubber 25. The solids flow downwardly through the reactor 2, pass stripping zone 17, to heater 3. The vaporized product stream passes through cyclone system 20 where entrained solids are removed and returned to the bed of fluidized solids via dipleg 22. A light product stream comprised of steam and 510° C. minus fractions are collected overhead via line 28. A heavy stream comprised of a 510° C. plus fraction is collected via line 26, at least a portion of which can be recycled to short vapor contact time reactor 1 via line 27.

The fluidized bed coking unit can be any conventional fluidized bed coking process unit and its specific configuration is not critical to the present invention. For illustrative purposes, a fluidized bed coking process unit is shown which is comprised of a coking reactor, a heater, and a gasifier. In broad terms, the operation of the coking unit proceeds as follows: a heavy hydrocarbonaceous chargestock is passed via lines 10*a* and 27 to coking zone 12 of coker reactor 2, which coking zone contains a fluidized bed of solid, or so-called "seed" particles, having an upper level indicated at 14. A fluidizing gas, e.g. steam, is admitted at the base of coker reactor 2, through line 16, into stripping zone 17 of the coking reactor in an amount sufficient to obtain a superficial fluidizing velocity. Such a velocity is typically in the range of about 0.5 to 5 ft/sec. A portion of the decomposed feed forms a fresh coke, or carbonaceous material, layer on the hot fluidized particles. The solids are partially stripped of fresh coke and occluded hydrocarbons in stripping zone 13 by use of a stripping gas, preferably steam and passed via line 18 to heater 3 which is operated a temperature from about 40° C. to 200° C., preferably from about 65° C. to 175° C., and more preferably about 65° C. to 120° C. in excess of the actual operating temperature of the coking zone The pressure in the coking zone is maintained in the range of about 0 to 150 psig, preferably in the range of about 5 to 45 psig. Conversion products from both the short vapor contact time reactor and the coking zone are passed through cyclone system 20 of the coking reactor to remove entrained solids which are returned to the coking zone through dipleg 22. The vapors leave the cyclone through line 24, and pass into scrubber 25, containing a scrubbing zone, at the top of the coking reactor. If desired, a stream of heavy materials condensed in the scrubber may be recycled to either short vapor contact time reactor 1 or to coking reactor 2 via lines 26 and 27 respectively. The coker conversion products are removed from the scrubber 25 via line 28 for fractionation in a conventional manner.

In heater 3, stripped coke from the stripping zone 17 of coking reactor 2 (cold coke) is introduced via line 18 to a fluidized bed of hot coke having an upper level indicated at 30. The bed is partially heated by passing a fuel gas into the heater via line 32. Supplementary heat is supplied to the heater by coke circulating from gasifier 4 through line 34. The gaseous effluent from the heater, including entrained solids, passes through a cyclone system which may be a first cyclone 36 and a second cyclone 38 wherein the separation of the larger entrained solids occurs. The separated larger solids are returned to the heater bed via the respective cyclone diplegs 39. The heated gaseous effluent, which contains entrained solids, is removed from heater 3 via line 40.

As previously mentioned, hot coke is removed from the fluidized bed in heater 3 and recycled to the short vapor contact time reactor 1 via line 42, then to coking reactor 2 to supply heat to both the short vapor contact time reactor and the coking reactor. It is understood that a portion of hot coke can also be passed directly to the coking zone 12. Another portion of coke is removed from heater 3 and passed via line 44 to a gasification zone 46 in gasifier 4 in which is also maintained a bed of fluidized solids to a level indicated at 48. If desired, a purged stream of coke may be removed from heater 3 by line 50.

The gasification zone is maintained at a temperature ranging from about 870° C. to 1100° C. at a pressure ranging from about 0 to 150 psig, preferably at a pressure ranging from about 25 to about 45 psig. Steam via line 52, and an oxygen-containing gas, such as air, commercial oxygen, or air enriched with oxygen via line 54, are passed via line 56 into gasifier 4. The reaction of the coke particles in the gasification zone with the steam and the oxygen-containing gas produces a hydrogen and carbon monoxide-containing fuel gas. The gasified product gas, which may contain some entrained solids, is removed overhead from gasifier 4 by line 32 and introduced into heater 3 to provide a portion of the required heat as previously described.

As previously mentioned, while the invention herein has been illustrated with a process unit comprised of a coking reactor, a heater, and a gasifier, it could just as well have been illustrated in a fluidized bed coking process unit containing only a coking reactor and a burner. Both of these types of fluidized bed coking units are very well known to those having ordinary skill in the art and thus it is not necessary to describe them in detail with respect to their ancillary equipment, such as values, compressors, pumps, etc.

What is claimed is:

1. A two stage process for converting a heavy hydrocarbonaceous feedstock having a Conradson Carbon content of at least about 5 wt. %, to lower boiling products; which process comprises:

(a) partially converting the feedstock to lower boiling products by introducing the feedstock into said first stage which is conducted in one or more short vapor contact time reactors comprised of a horizontal moving bed of fluidized hot inert particles wherein upon contact of the feedstock with the hot particles vapor phase products are produced and carbonaceous material is deposited onto the hot particles, which first stage is operated: (i) at a temperature from about 450° C. to about 700° C.; (ii) under conditions such that the solids residence time and the vapor residence time are independently controlled, which vapor residence time is less than about 2 seconds, and which solids residence is from about 5 to about 60 seconds; and (b) further converting said partially converted feedstock to lower boiling products in a second stage comprised of a fluidized bed coking process unit comprised of a coking reactor and a burner, said coking reactor containing a coking zone, a scrubbing zone located above the coking zone for collecting vapor phase products, and a stripping zone located below the coking zone for stripping hydrocarbons from particles passing downwardly from the coking zone, which second stage is operated by:

(i) passing the vapor phase product from said first stage to said scrubbing zone of a fluidized bed coking process unit wherein entrained particles are removed and conversion products are collected overhead;

(ii) collecting, from the scrubbing zone, a stream of light products having an average boiling point equal to or less than about 510° C.;

(iii) collecting, from the scrubbing zone, a product stream having average boiling point of greater than about 510° C.;

(iv) passing, from the first stage, the particles having carbonaceous material deposited thereon to the coking zone of a fluidized bed coking process unit, past the stripping zone where hydrocarbons are stripped with a stripping gas;

(v) passing a portion of said stripped solid particles from the stripping zone to said burner containing a combustion zone which is comprised of a fluidized bed of solid particles and which is operated at a temperature from about 40° to 200° C. greater than that of the coking zone to partially combust carbonaceous material on said particles, thereby heating said particles to a temperature in excess of the temperature of the coking zone; and (vi) recycling at least a portion of the heated particles from the combustion zone to said short contact time reactor of said first stage.

2. The process of claim 1 wherein a portion of the heated particles are passed from the burner to the coking zone.

3. The process of claim 1 wherein the vapor residence time of the first stage is less than about 1 second.

4. The process of claim 1 wherein the feedstock is a vacuum resid.

5. The process of claim 3 wherein the solids residence time of the first stage is from about 10 to 30 seconds.

6. The process of claim 1 wherein the short vapor contact time reactor of said first stage is a unit is which a mechanical means is used to assist in fluidizing the particles.

7. The process of claim 6 wherein the mechanical means is comprised of set of horizontally disposed screws within said short vapor contact time reactor.

* * * * *